US005499860A

United States Patent [19]

Smith et al.

[11] Patent Number: 5,499,860

[45] Date of Patent: Mar. 19, 1996

[54] COLLAPSIBLE CHILD SEAT

[75] Inventors: Raymond Smith, Los Angeles; Charles Roelen, Laguna Niguel, both of Calif.

[73] Assignee: Tricor Seating, Inc., Laguna Beach, Calif.

[21] Appl. No.: 180,850

[22] Filed: Jan. 12, 1994

[51] Int. Cl.[6] ..... A47C 1/08

[52] U.S. Cl. ..... 297/255; 297/183.5; 297/485; 297/256

[58] Field of Search ..... 297/183.1, 183.5, 297/254, 255, 256, 256.1, 256.13, 17, 485, 467, 487, 483

[56] References Cited

U.S. PATENT DOCUMENTS

| | | | |
|---|---|---|---|
| 340,139 | 10/1893 | McCaskill . | |
| 1,493,467 | 5/1925 | Butt et al. | 297/183.5 X |
| 1,641,952 | 9/1927 | Abraham | 297/255 |
| 1,641,953 | 9/1927 | Abraham . | |
| 2,508,822 | 5/1950 | Goldberg . | |
| 3,061,371 | 10/1962 | Benoit | 297/256 |
| 3,366,294 | 1/1968 | Stephenson | 297/485 X |
| 3,604,750 | 9/1971 | Doering . | |
| 4,592,592 | 6/1986 | Peek | 297/483 |
| 4,702,523 | 10/1987 | Schrader et al. . | |
| 4,871,210 | 10/1989 | Alexander | 297/485 |
| 4,889,388 | 12/1989 | Hime . | |
| 5,205,610 | 4/1993 | Reninger . | |

FOREIGN PATENT DOCUMENTS

| | | | |
|---|---|---|---|
| 649206 | 5/1985 | Switzerland | 297/485 |

*Primary Examiner*—Laurie K. Cranmer
*Attorney, Agent, or Firm*—Knobbe, Martens, Olson & Bear

[57] ABSTRACT

A collapsible child seat is provided which has an adjustable bottom panel so as to position the bottom panel in a position generally parallel to a supporting chair seat. The child seat comprises a bottom panel hinged to a back panel. A rear sleeve, which is configured to receive at least an upper portion of the chair backrest, is attached to the back panel. The child seat further includes a support strap which attaches to opposing side edges of the bottom panel and slidably connects to the rear sleeve. When the rear sleeve is slipped over the chair backrest, the child seat is suspended above the chair seat. The support strap extends around the rear of the chair seat and supports the bottom panel in a position generally parallel to the chair seat. The support strap desirably is adjustable in length to draw the rear sleeve around the chair backrest and to adjust the position of the bottom panel.

24 Claims, 4 Drawing Sheets

Fig. 5
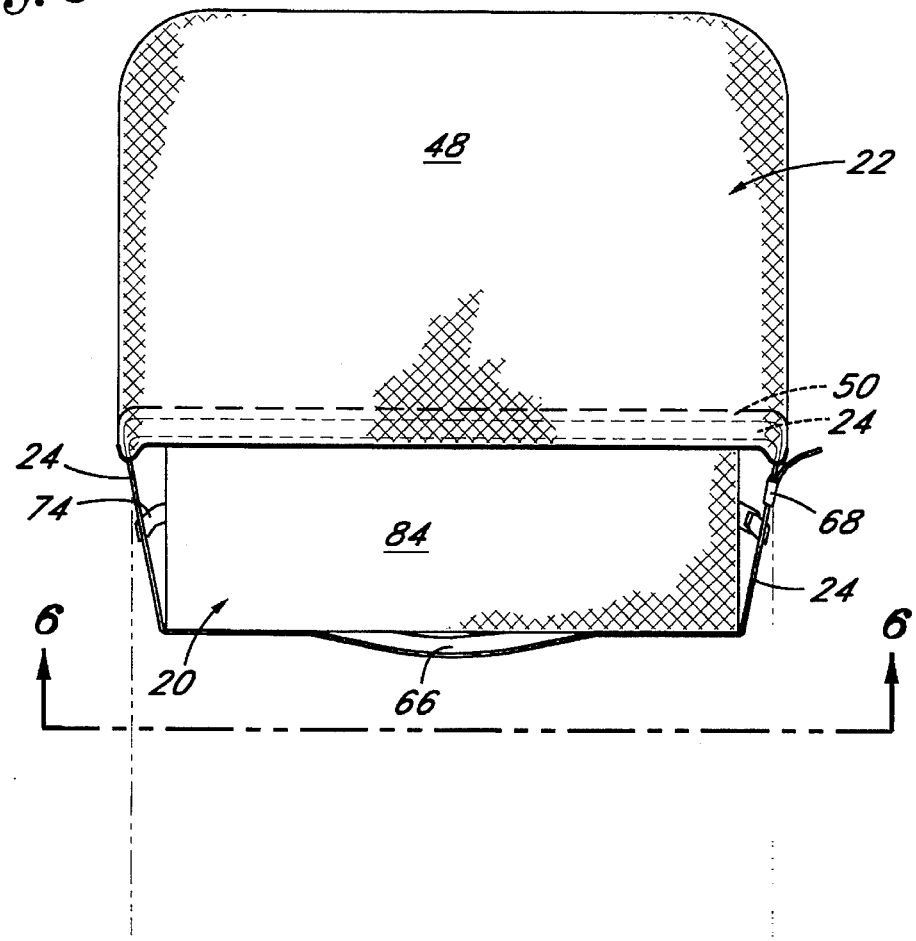
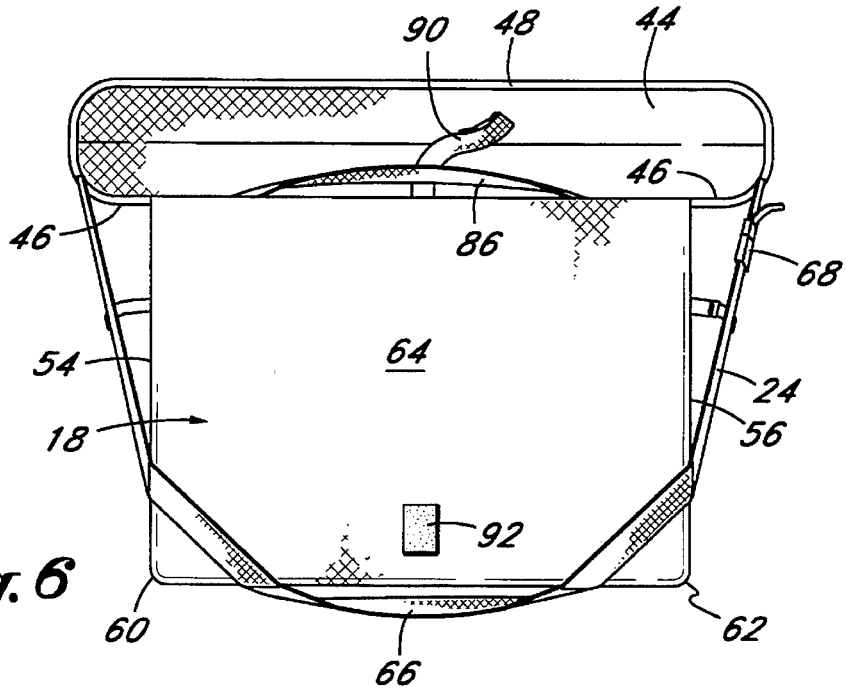
Fig. 6

COLLAPSIBLE CHILD SEAT

BACKGROUND OF THE INVENTION

1. Field of the Invention

The present invention relates in general to a child seat, and in particular to a collapsible child seat.

2. Description of Related Art

Young children commonly have difficulty seeing a movie screen or stage when seated in a conventional theater seat. The eye-level of a young child seated on a seat of the conventional theater chair is typically below the top of a chair backrest or a person positioned or seated in front of the child. Thus, the person and/or seat in front of the child obscures the child's view of the screen or the stage.

Children also commonly have difficulty supporting themselves upright when seated in the standard theater chair. Children tend to tilt, slouch or kneel in conventional theater chairs because the oversize chair does not properly support the child. Children may even slip off the seat when slouching.

Booster chairs have been used to elevate the child above the seat of the theater chair. U.S. Pat. No. 4,889,388 discloses an example of a prior booster chair. Prior booster chairs, however, are bulky and are not easily transportable. Because of their shape and size, many parents of young children also find it cumbersome and awkward to carry a booster chair into a theater. Some parents may further be embarrassed because such bulky booster chairs are obtrusive in crowds and are conspicuous.

Collapsible chairs have also been used to elevate a child. These chairs suspend from the backrest of a chair or car seat. U.S. Pat. Nos. 1,641,953 and 2,508,822 disclose examples of such prior suspension-type child chairs.

These prior collapsible, suspension-type child chairs, however, suffer from several drawbacks. The construction of these prior chair is complicated, which in some cases may make the chair difficult to assemble, to attach to a chair and/or to use. The hardware of the prior chairs may also damage the upholstery of the support structure (e.g., chair). The complicated construction further increases the manufacturing costs of these collapsible child chairs. These prior devices are also conspicuous, heavy and not easily transportable. Moreover, these devices cannot be adjusted to different chair sizes onto which the child chair is attached.

SUMMARY OF THE INVENTION

In view of the foregoing drawbacks and shortcomings of prior child booster chairs, there exists a need for a collapsible, lightweight child seat, which is simple in design, is easy to use, is easy to transport, and is adjustable to various size chairs or like supports.

The present child seat is simply structured, is lightweight, and is collapsible for easy travel. The child seat also does not damage the chair onto which the child seat is attached. The simple design of the child seat further provides for facile conversion from the collapsed travel position to an unfolded seat position. In the seat position, the child seat is easily attached to the support chair by slipping a portion of the child seat over the backrest of the supporting chair.

In accordance with an embodiment of the child seat, the child seat includes an adjustment mechanism which allows a bottom panel of the child seat to be positioned generally parallel to the seat of the chair onto which the child seat is attached. The child seat is also designed to adjust to various sizes of supporting chairs.

The child seat includes the bottom panel having opposing side edges and a rear panel which is hinged to the bottom panel. A rear sleeve is attached to the rear panel. The rear sleeve defines a pocket which is configured to receive at least an upper portion of the chair backrest onto which the child seat is attached. The child seat further includes a support strap which extends between the rear sleeve and each side edge of the bottom panel. The support strap is fixedly attached to either the bottom panel or the rear sleeve and is slidably connected to the other. The support strap is also adjustable in length so as to draw the rear sleeve around the chair backrest and to adjust the position of the bottom panel relative to the seat of the chair supporting the child seat.

In a preferred embodiment, the support strap extends around the backrest with the sleeve pocket receiving a portion of the chair backrest. The rear sleeve desirably includes a strap loop through which the support strap extends around the back of the chair backrest.

In a preferred embodiment, the support strap is attached to a first side edge of the bottom panel. The support strap extends over the bottom surface towards a front edge of the bottom panel, extends from the front edge, loops back towards the front edge and attaches to the front edge to form a handle. The support strap also extends over the bottom surface to the second side edge and is attached thereto.

Additionally, the child seat may comprise a handle attached to the back panel at a top edge, inside the rear sleeve pocket. This handle may be used to carry the child seat when collapsed.

The child seat may further include a retaining belt attached to the support strap on either side of the bottom panel. The retaining belt is desirably positioned to pass across the lap of the child when the child sits within the child seat. The child seat may further include a central strap attached to the retaining belt and to the bottom panel of the seat. The central strap desirably is positioned to extend between the legs of the child when the child sits on the bottom panel with the retaining belt drawn across the lap of the child.

In accordance with the preferred method of supporting a child above a chair, a child seat is provided which has hinged bottom and back panels. The bottom panel is folded away from the back panel to a position in which the bottom panel is generally normal to the back panel. A rear sleeve, attached to the back panel, is slipped over at least an upper portion of the chair backrest to suspend the child seat from the chair backrest. A support strap, which interconnects the rear sleeve and the bottom panel, is positioned around the back of the chair backrest and is adjusted to draw the rear sleeve tightly around the child backrest and to position the bottom panel in a position generally parallel to the chair seat. A child may then be inserted into the child seat to elevate the child above the seat of the chair on to which the child seat is attached.

In accordance with another aspect of the present invention, a collapsible child seat is provided, including a rigid bottom panel and a back panel hinged to the bottom panel. A rear sleeve is attached to the back panel and has a pocket configured to receive at least an upper portion of a backrest of a chair to which the child seat is attached. The rear sleeve is invertible to fold from a first position on one side of the back panel to a second position on the opposite side of the back panel. The child seat further includes a support strap which extends between the back panel and the bottom panel to support the bottom panel in a generally cantilevered position, away from the back panel.

BRIEF DESCRIPTION OF THE DRAWINGS

These and other features of the invention will now be described with reference to the drawings of a preferred embodiment which is intended to illustrate and not to limit the invention, and in which:

FIG. 5 is a rear elevational view of the child seat of FIG. 1; and

FIG. 6 is a bottom plan view of the child seat of FIG. 5 as viewed from line 6—6.

DETAILED DESCRIPTION OF A PREFERRED EMBODIMENT

Figure 1:
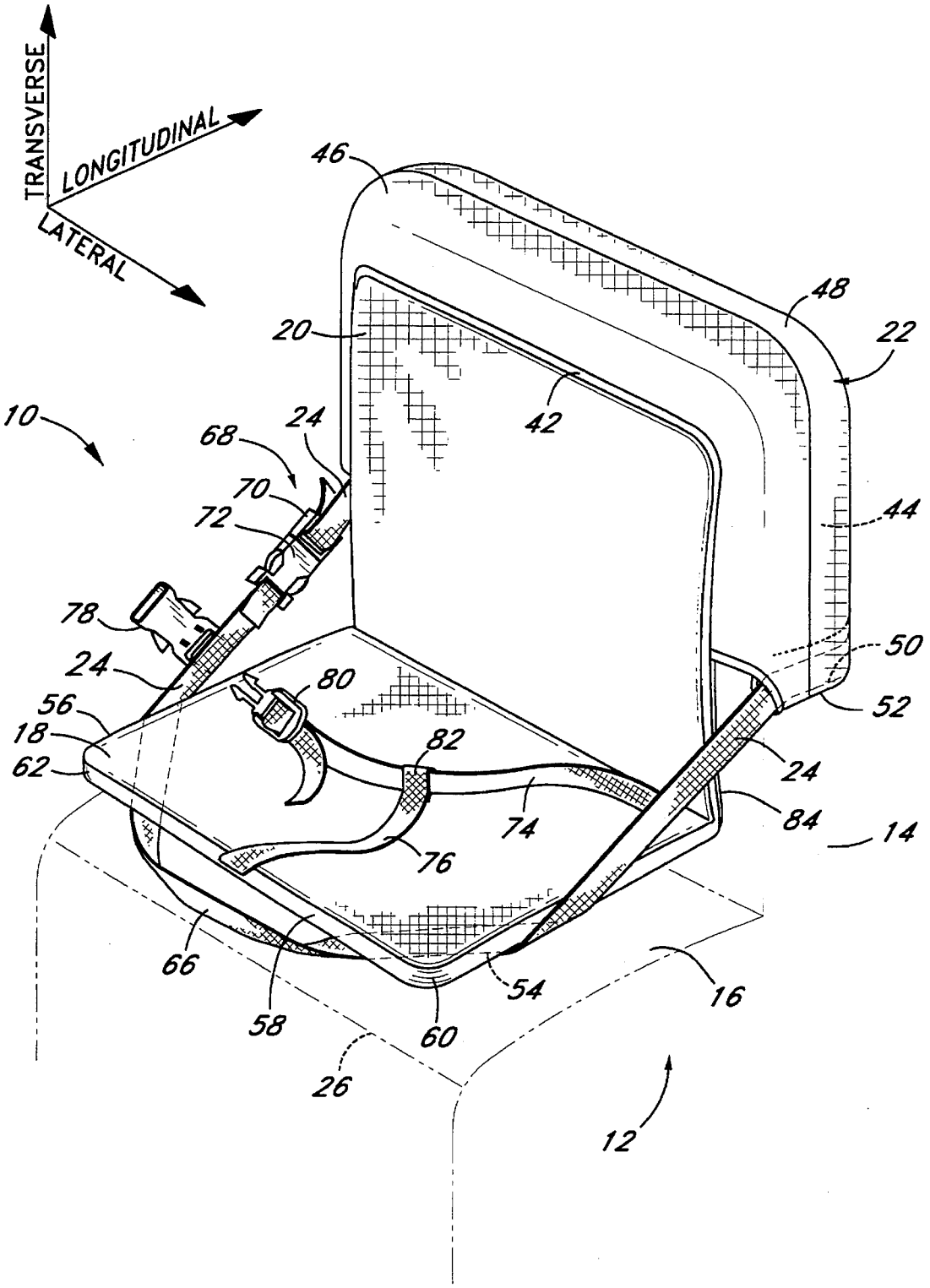
FIG. 1 is a front perspective view of a child seat in accordance with a preferred embodiment of the present invention, attached to a conventional theater chair.

FIG. 1 illustrates a collapsible child seat 10 in accordance with a preferred embodiment of the present invention, attached to a conventional theater chair 12. Although the figures and the disclosure herein discussed the child seat 10 in connection with a conventional theater seat, it is understood that those skilled in the art will readily appreciate that the present invention can be designed for use with other types of chairs and supports as well.

The child seat 10 is desirably attached to a backrest 14 of the theater chair 12 to suspend it from the backrest 14 above a seat 16 of the theater chair 12. The child seat 10, because of its generally soft and smooth exterior edges and surfaces and its general lack of hardware, will not likely damage the upholstery of the theater seat 16. The child seat 10 is designed such that, when the child seat 10 is attached to the backrest 14, a child seated in the chair 10 is sufficiently elevated to see over a chair and/or person present in front of the child.

Figure 2:
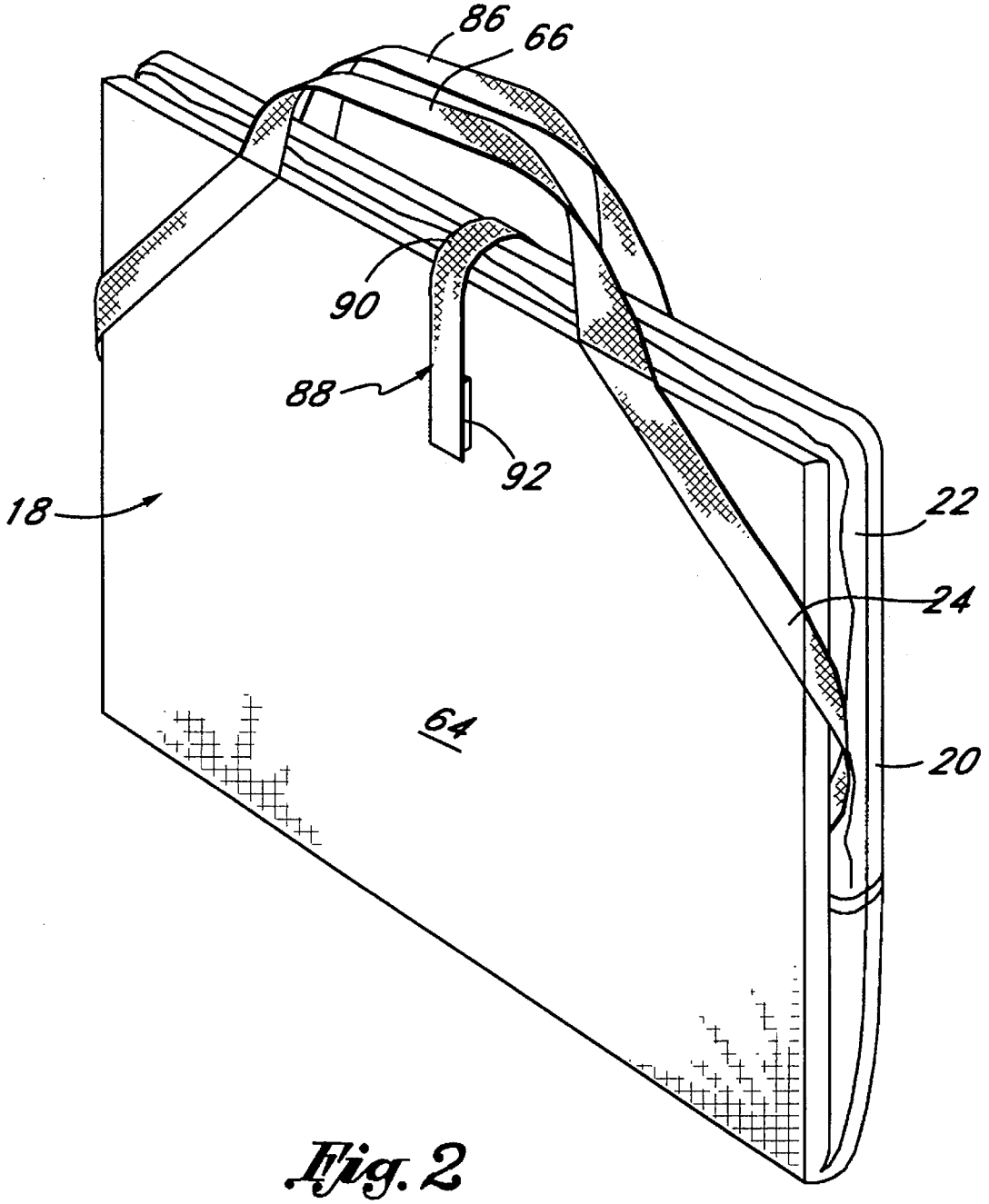
FIG. 2 is a front perspective view of the child seat of FIG. 1 positioned in a collapsed position.

The child seat 10 is also collapsible so as to be easily carried and stored. FIG. 2, which will be discussed in detail below, illustrates the child seat 10 collapsed for easy travel. The child seat 10 also has a simple construction and is formed of lightweight material so as to be easily carried. When collapsed, the child seat 10 generally has a streamline, briefcase-like appearance.

With reference to FIG. 1, the child seat 10 principally comprises a bottom panel 18 hinged to a back panel 20. A rear sleeve 22, which is configured to receive at least a portion of the backrest 14, is attached to the upper portion of the back panel 20. As illustrated by FIG. 1, the rear sleeve 22 slips over the backrest 14 of the theater chair 12 to suspend the bottom panel 18 above the theater chair seat 16. At least one support strap 24 connected to the rear sleeve 22 desirably supports the bottom panel 18 in a generally horizontal position when the child seat is unfolded for use. The support strap 24 preferably holds the bottom panel 18 above the theater chair seat 16 by about two to six inches (5.1–15.3 cm). It is contemplated, however, that the height could be readily tailored to suit specific applications. Also, it is understood that the adjustment strap 24 can be used to adjust the height of the bottom panel 18 above the chair seat 16, as discussed in detail below.

FIG. 1 illustrates a longitudinal axis, a transverse axis and a lateral axis in relation to the child seat 10 to aid the following description of the child seat 10. Additionally, as used herein, the words "front" and "rear" are used in reference to the proximally of a front edge 26 of the theater chair 12, and the terms "top" and "bottom" are used in reference to the seat 16 of the theater chair 12. The individual components of the child seat 10 will now be described in detail.

The bottom panel 18 preferably has a generally rectangular shape and is sufficiently rigid to support the weight of the child sitting on the bottom panel 18. The bottom panel 18 desirably can support a fifty pound child without noticeably bending or bowing (e.g., deflection greater than 1.0 inch). The bottom panel 18 is also sized to fit between the arm rests (not shown) of the theater chair 12. That is, the lateral width of the bottom panel 18 is less than the distance between the arm rests of a conventional theater chair 12. In an exemplary embodiment, the bottom panel has a longitudinal length of about 12 inches (30.5 cm) and a width, as measured in the lateral direction, of about 15 inches (38.1 cm). It is contemplated, however, that other shapes and sizes can be used as well, depending upon the specific application of the child seat 10.

Figure 3:
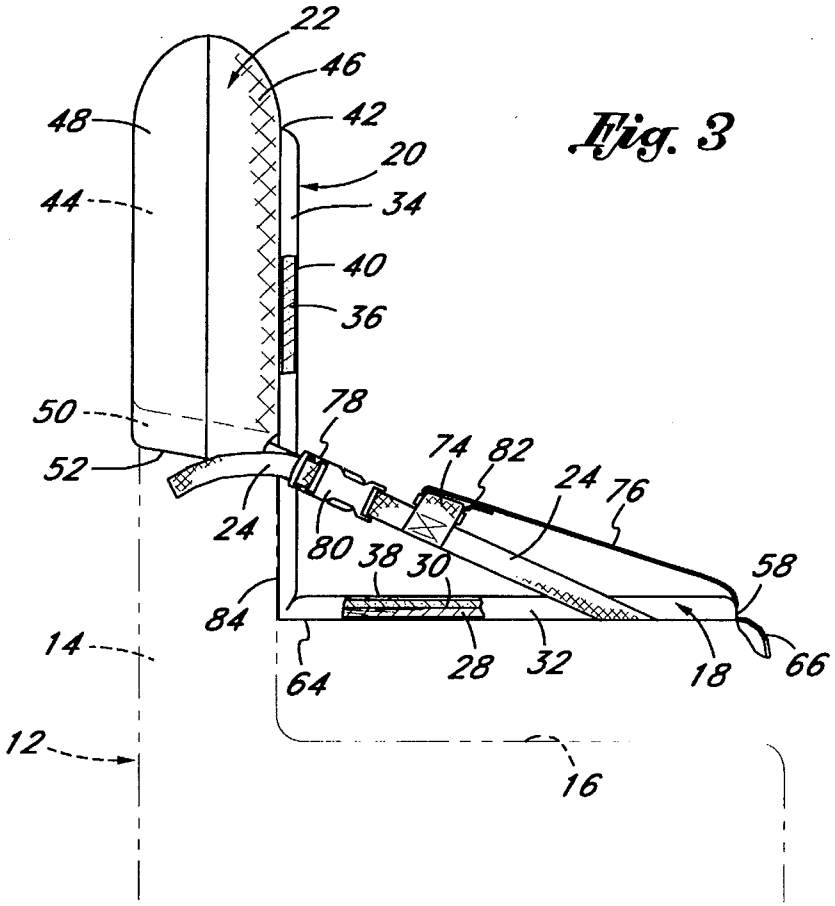
FIG. 3 is a left side elevational view of the child seat of FIG. 1.

With reference to FIG. 3, the bottom panel 18 comprises a stiff support member 28. In an exemplary embodiment, the support member preferably comprises a ¼ inch (0.6 cm) thick piece of plywood; however, other rigid plates of material, such as, for example, metal alloys, plastics or composites, of various thicknesses, can be used as well.

A cushion 30 may cover the support member 28. The cushion 30 desirably provides sufficient padding to soften the support member 28 and to dissipate the weight of the child over the support member 28. Any of a wide variety of materials, laminates, composites or other structures or compositions having sufficient elasticity can be used. In an exemplary embodiment, the cushion 30 comprises a polymer form, such as, for example, polyurethane, of a thickness ranging between ⅛ inch (0.32 cm) to 6.0 inch (15.2 cm), more preferably ranging between ½ inch (1.3 cm) to 1.0 inch (2.54 cm), and most preferably equaling about ½ inch (1.3 cm). However, it is contemplated that a thinner cushion could be used if the density of the cushion is increased.

As illustrated in FIG. 3, an outer shell 32 covers the support plate 28, as well as the cushion 30. In an exemplary embodiment, the shell 32 comprises a sheet of material folded and sown together along its edges to form a pocket into which the support plate 28 and cushion 30 are inserted. An end of the lower piece of material (not shown) is folded back into the pocket to cover the rear end of the panel 28 and cushion 30, as known in the art.

FIG. 1 best illustrates the rear panel 20 of the child seat 10. As noted above in connection with the bottom panel 18, although the back panel is described and illustrated as having a generally rectangular configuration, it is contemplated that other shapes (e.g. circular, triangular, square, etc.) can be used as well. In an exemplary embodiment, the rear panel 20 has a generally rectangular shape of a sufficient sized to generally cover the back of the child. The transverse length of the rear panel 20 desirably extends from the child's buttocks to a point proximate to the child's shoulders. For instance, the rear panel 20 in an exemplary embodiment has a transverse height of approximately 13 inches (33 cm) for use with an average sized child of age 5. However, it is understood that the transverse height of the rear panel 20 can be readily customized to suit a specific child size.

The rear panel 20 also has a sufficient lateral width to cover the back of the child. In an exemplary embodiment, the rear panel 20 has a lateral width of approximately 15 inches (38.1 cm) for use with an average sized child of age 5. It is again understood, however, that the width of the rear panel can be readily customized to fit a particular sized child. The rear panel 20 desirably has generally the same shape as that of the bottom panel 18 and is generally coextensive in width and length with the bottom panel 18. Thus, as illustrated in FIG. 2, when the child seat 10 is folded to position the rear and bottom panels 20, 18 adjacent to each other, the child seat 10 has a generally uniform, symmetric appearance.

As illustrated in FIG. 3, the rear panel 20 desirable comprises an outer shell 34 which covers a cushion 36. Similar to the outer shell 32 of the bottom panel 18, the outer shell 34 of the rear panel 20 is formed by folding a sheet of cloth or material and sewing the cloth along its edges to form a pocket. The pocket is sized to receive the cushion 36. A lower edge (not shown) of the rear piece 84 of the sheet is folded into the pocket, over the bottom edge of the cushion 36, to cover the cushion 36 and to close the pocket.

The cushion 36 of the rear panel 20 has a generally rectangular shape of a width and height generally equal to that of the rear panel 20 described above. The cushion 36 desirably provides sufficient padding to cushion the back of the child. The cushion 36 preferably also has sufficient structural integrity to define the generally rectangular shape of the rear panel 20. Any of a wide variety of elastic materials, laminates, composites or other structures or compositions having sufficient structural integrity can be used. In one embodiment, the cushion 36 comprises a polymer foam, such as, for example, polyurethane of a thickness ranging between 0.125 inch (0.32 cm) to 6.0 inch (15.2 cm), more preferably ranging between 0.5 inch (1.3 cm) and 1.0 inch (2.5 cm), and most preferably equaling about 0.5 inch (1.3 cm). However, it is contemplated that a thinner cushion could be used if the density of the cushion is increased.

The cushions 32, 36 of the bottom and rear panels 18, 20, however, desirably are not so thick as to prevent the panels from folding together in the collapsed position. It is therefore preferred that the cushions 30, 36 have a thickness of less than about 1.0 inch (2.5 cm), and more preferably have a thickness of no more than about 0.5 inch (1.3 cm).

The rear panel 20 and the bottom panel 18 are hinged together such that the bottom panel 18 moves from a first position in which the panels 18, 20 are adjacent to each other, to a second in which the bottom panel 18 is generally normal to the rear panel 20. In an exemplary embodiment, the panels 18, 20 are hinged together by forming the outer covers 32, 34 of the panels 18, 20 from an integral sheet of material. As illustrated in FIG. 3, the upper piece 38 of the bottom panel outer shell 32 connects to the forward piece 40 of the rear panel outer shell 34, and are preferably integrally formed together. In this manner, the panels 18, 20 are hinged together.

The outer shells 32, 34 of the bottom and rear panels 18, 20 are preferably comprised of a rugged, durable, lightweight, washable weave material. In an exemplary embodiment, the shell is desirably formed of 420 Denier Nylon. The shells 32, 34 can also be formed of 70 Denier Nylon, Nylon 1000 Denier Cordura, 600 denier polyester, cotton duck or the like.

With reference to FIGS. 1 and 3, the rear sleeve 22 is attached to an upper end 42 of the rear panel 20 and extends in a rearward direction. The rear sleeve 22 defines a pocket 44 which is sized to receive at least an upper portion of the backrest 14 of the theater chair 12. The width of the defined pocket 44 (measured in the longitudinal direction) is preferably generally equal to the width of a conventional theater seat backrest 14. In an exemplary embodiment, the width ranges between 2 and 8 inches (5.1–20.3 cm) and more preferably equals approximately 4.0 inches (10.2 cm). However, the dimensions and shape of the pocket 44 can readily be customized to suit specific applications.

As FIG. 3 illustrates, the rear sleeve 22 has a transverse length desirable equal to at least one quarter of the transverse height of the theater seat backrest 16, and more preferably equal to about one-third the height of the backrest 14. In an exemplary embodiment, the rear sleeve 22 has a transverse length equal to about 12 inches (30.5 cm). It is again contemplated, however, that the size of the rear sleeve 22 can be readily customized to suit specific applications.

With reference to FIGS. 1 and 3, the sleeve 22 is desirably formed by two panels of material. A central strip 46 is sewed around the upper portion of the rear panel 20. That is, the central strip 46 extends from about the midsection of the rear panel 20 on one side, up around the upper edge 42 of the rear panel 20, and down to about the midsection of the opposite side of the rear panel 20. The center strip 46 is preferable sewed between the two plies of the outer shell 34 of the rear panel 20.

A back sheet 48 is sewed onto the central strip 46 to form the sleeve 22. The back sheet 48 has a lateral width substantially equal to the width of the theater seat backrest 14. And the transverse height of the back sheet 48 is desirably coextensive with the transverse length of the central strip 46 along the side edge of the rear panel 22.

As best seen in FIGS. 3 and 5, the rear sleeve 22 includes a strap loop 50. The strap loop 50 extends around at least a portion of the back sheet 48 of the sleeve 22, and more preferably extends completely around the sleeve 22, from one side of the central strip 46 to the other. The loop 50 is sized to receive the support strap 24 in a manner that the support strap 24 can slide through the loop 50.

The loop 50 is preferably positioned at a lower edge 52 of the sleeve 22 for manufacturing ease; however, it is contemplated that the loop 50 could be positioned at a variety of other positions on the rear sleeve 22.

The loop 50 is advantageously formed by folding the lower ends of the back sheet 48 and center strip 46 into the pocket 44 and sewing the corresponding ends to the back sheet 48 and the center strip 46 at a point distal of the fold. The loop 50 is thus formed between the fold of material plies, as known in the art. A welting (not shown) preferably boarders the edge of the central strip 46 and back sheet 48 to prevent the material from fraying.

FIGS. 1 and 6 best illustrates the support strap 24. The support strap 24 passes through the strap loop 50 and attaches to both the right and left sides 54, 56 of the bottom panel 18. It is also contemplated that the strap 24 could alternatively attach to front edge 58 of the bottom panel 18. The strap 24 is preferably fixed to the bottom panel 18 proximate to the front corners 60, 62 of the panel 18 so as to support the front edge 58 of the panel 18 which cantilevers outwardly, away from the theater seat backrest 14, when used.

Although the support strap 24 is illustrated and described as attached to the bottom panel 18 and slidably connected to the rear sleeve 22, it is contemplated that the support strap 24 could alternatively be permanently attached to the rear sleeve 22 and slidably connected to the bottom panel 18. It is further contemplated that the support strap 24 could be slidably connected t both the bottom panel 18 and the rear sleeve 24 or could be permanently attached to both the bottom panel 18 and the rear sleeve 24; however, the latter configuration may not provide the desired adjustability. It is also contemplated that the child seat 10 could have more than one support strap 24 as well.

In an exemplary embodiment, such as that illustrated in the figures, the support strap 24 extends from the rear sleeve 22 to the right side edge 54 of the said bottom panel 18. The strap 24 is preferably affixed to the bottom surface 64 of the bottom panel 18 proximate to the right front corner 60. The strap 24 is desirably sewed to a bottom surface 64 of the bottom panel 18; however, the strap 24 could also be attached to the bottom panel in a variety of ways known in the art (e.g., gluing, riveting, stapling, etc.).

The support strap 24 extends from the right side edge 54, at a point proximate to the front right corner 60, diagonally across the front corner 60, over said bottom surface 64 and toward the front edge 58 of the bottom panel 18.

The strap 24 extends from the front edge 58, and loops back towards the front edge 58. The strap 24 is attached to the bottom surface 64 along the front edge 58 at a point proximate to the left front corner 62 of the bottom panel 18. As best seen in FIG. 1, the loop formed by the strap 24 beyond the front edge 58 of the panel 18 forms a handle 66.

With reference to FIGS. 1 and 6, the strap 24 extends diagonally across the left front corner 62 to the left side edge 56 of the bottom panel 18. From the left side edge 56, proximate the left front corner 62, the strap 24 extends toward the rear panel 20 and through the strap loop 50 of the rear sleeve 22.

The support strap 24 is preferably formed of a durable webbing strip of sufficient strength to support a child of 50 pounds or so. Thus, the tensile strength of the strip 24 is preferably at least 25 force pounds (110 Newton), and more preferably sufficiently greater to provide an adequate level of safety. In an exemplary embodiment, the strap comprises a nylon webbing strip of a width of about 1.5 inches (3.8 cm). It is also understood that the strip could have a variety of known different shapes (e.g., a cord) and sizes other than those described herein to support the bottom panel 18 as described.

The support strap 24 advantageously is adjustable so as to pull the rear sleeve 22 tightly about the theater seat backrest 14 and to adjust the level of the bottom panel 18. That is, the strap 24 can be shortened or lengthened in order to hold the bottom panel 18 in a generally horizontal position (i.e., generally parallel to the seat 16 of the theater chair 12) with a child sitting on the bottom panel 18. The adjustment of the strap 24 also provides for a limited amount of adjustment to the height of the bottom panel 18 above the chair seat 16.

The strap 24 thus desirably has a sufficient length to extend around the rear sleeve 22 (and thus around the backrest 14 of the theater chair 12), and under the bottom panel 18 of the child seat 10, as described above, plus has an additional length to allow for the desired adjustability. The length of the strap 24 advantageously allows for various size theater seats. In an exemplary embodiment, the strap has a length of approximately 36.0 inches (91.4 cm) as measured from the point of attachment to the right side edge 54 of the bottom panel 18 to the point of attachment to the left side edge 56 of the bottom panel 18. As will be readily appreciated by those skilled in the art, however, the length of the strap 24 can be selected in a variety of different lengths depending upon the specific application of the child seat 10.

FIGS. 1 and 3 illustrate the strap as including a quick connect fastener 68, such as, for example, a buckle type fastener, available commercially as FASTEX™ from ITW NEXUS of Wood Dale, Ill. It is contemplated, however, that other types of fasteners, such as, for example, VELCRO®, snaps, ties, and the like can be used as well. One end of the strap 24 is passed through a pair of parallel apertures of a prong element 70 of the quick-connect fastener 68 to couple the prong element 70 of the fastener 68 to the strap 24. In this manner, the prong element 70 of the quick-connect fastener 68 can be positioned at various positions along the length of the strap 24, as known in the art. The other end of the strap 24 is attached to a socket element 72 of the quick-connect fastener 68 which cooperates with the prong element 70 of the quick-connect fastener 68 to interconnect the ends of the strap 24.

With reference to FIG. 1, the child seat 10 may additionally include a lap strap 74 and a central strap 76 to retain the child within the seat 10. The lap strap 74 is attached to opposite sides of the support strap 24 which extend between the rear sleeve 22 and the bottom panel 18. The lap strap 74 is preferably adjustable in length to pull the strap 74 tightly across the lap of the child. For this purpose, the lap strap 74 includes an adjustable fastener. Although it is contemplated that any of a variety of fasteners could be used (e.g., VELCRO®, snaps, ties, etc.), it is preferred that the adjustable fastener comprises an adjustable, quick-connect buckle, such as the FASTEX® buckle, available commercially from ITW NEXUS of Wood Dale, Ill. The lap strap 74 is severed at a point between the opposing segments of the support strap 24, preferably proximate to one of the support strap segments. At this point, one end of the lap strap 74 is attached to a socket element 78 of the quick-connect buckle, while the other end is inserted through parallel apertures of a prong element 80. The strap 74 can be pulled through the parallel apertures of the prong element 80 to either tighten or loosen the lap strap 74, as known in the art.

Figure 4:
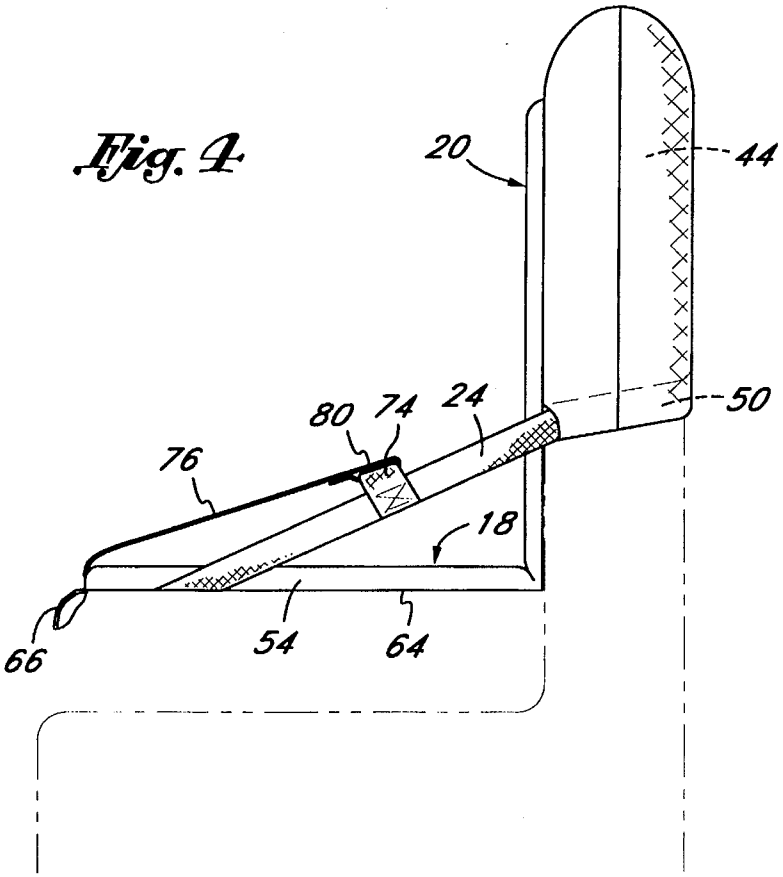
FIG. 4 is a right side elevational view of the child seat of FIG. 1.

The central strap 76 attaches to the front edge 58 of the bottom panel 18. The central strap 76 is preferably sewed between the two plies of the outer shell 32 of the bottom panel 18. The central strap 76 extends from the front edge 58 of the bottom panel 18 and slidably attaches to the lap strap 74. For this purpose, the central strap 76 desirable includes a loop 82 at its upper end. As best seen in FIG. 4, the lap strap 74 is inserted through the loop 82 to slidable connect the central strap 76 to the lap strap 74. In this manner, the upper end of the central strap 76 can slide over the lap strap 74 for comfort purposes, as known in the art.

When in use in a seated position as illustrated in FIG. 1, the rear sleeve 22 is positioned on the back side of the rear panel 20. That is, the center strip 46 of the sleeve 22 extends rearward, away from the bottom panel 18 in the longitudinal direction. The sleeve 22 is then slipped over the top of the theater chair 12. Specifically, the backrest 14 of the theater chair 12 slips into the pocket 44 formed by the rear surface 84 of the rear panel 20, the center strip 46 and the back sheet 48. In this position, the child seat 10 hangs from the top of the theater chair backrest 14 with the bottom panel 18 elevated above the seat 16 of the theater chair 12, typically between the arm rests (not shown). The back panel 20 lies substantially adjacent to the chair backrest 14.

The strap 24 passes around the rear of the theater chair backrest 14. As discussed above, the strap 24 extends from the strap loop 50 at the lower end of the rear sleeve 22 and passes under the front corners 60, 62 of the bottom panel 18 to support the bottom panel 18 in a generally horizontal position.

The support strap 24 is then adjusted to pull the rear sleeve 22 tightly around the backrest 14 of the theater chair 12 and to position the bottom panel 18 in a generally horizonal position (i.e., generally parallel to the theater chair seat 16). To ease the adjustment of the support strap 24, the prong element 70 of the quick-connect fastener 68, may be disconnected from the corresponding socket portion 72. The strap 24 can then be drawn through the apertures of the prong element 70 to re-position the prong element 70 on the strap 24. In this manner, the effective length of the strap 24 can be either lengthen or shortened. The prong element 70 may then be pressed into the socket clasp 72 to connect the ends of the support strap 24.

A child is placed in the child seat 10 by sitting the child on the bottom panel 18. One leg of the child may be inserted between the center strap 76 and the lap belt 74 to position the center strap 76 between the child's legs. The lap strap 76 is buckled in place and drawn tight across the lap of the child to retain the child within the seat 10. The support strap 24 may then be re-adjusted to raise the bottom panel 18 to a horizontal position if required when under the weight of the child.

When not in use, the child seat 10 can be collapsed for travel or storage, as illustrated in FIG. 2. To collapsed the child seat 10, the rear sleeve 22 is inverted to position the rear sleeve 22 on the front side of the rear panel 20. That is, the rear sleeve 22 is rolled over the top 42 of the rear panel 20 such that the rear sleeve 22 is in front of the rear panel 20 and the center strip 46 extends in the forward direction. In this position, the support strap 24 lies loosely between the bottom and rear panels 18, 20.

The rear and bottom panels 18, 20 can then be folded together with the rear sleeve 22 and support strap 24 positioned between the panels 18, 20. As illustrated in FIG. 2, the child seat 10 thus folds into a streamline, rectangular, case-like tote.

With reference to FIG. 2, the child seat 10 preferably includes a second handle 86 sewed onto top 42 of the rear panel 20 between the rear sheet 84 of the rear panel 18 and the center strip 46. The handle 86 so positioned is only exposed when the rear sleeve 22 is inverted (i.e., positioned on the front side of the rear panel 20). The handle 86 is preferably formed of a web strip similar to that of the support strap 24, which forms the first handle 66. In an exemplary embodiment, the second handle 86 is formed of a 1.5 inch (3.8 cm) wide, nylon weave strip.

The child seat 10 also desirably includes a fastener 88 to hold the panels 18, 20 together when the child seat 10 is collapsed. The fastener 88 preferably comprises a strip of nylon webbing 90. The strip 90 is sewed between the plies of the rear sheet 86 of the rear panel 20 and center strip 46 so as to be exposed only when the rear sleeve 24 is inverted. A hook portion of a hook-and-loop type fastener 92 (e.g., VELCRO®) is attached to the loose end of the strip 90, and a corresponding loop portion of the fastener 92 is attached to the bottom surface 64 of the bottom panel 18. It is understood that the hook and loop portions of the hook-and-loop type fastener 92 may be reversed. It is also understood that other type of fasteners, such as, for example, ties, snaps, buckles, etc., could be used as well to hold the panels together when in the collapsed position.

In the folded travel position, the strip 90 is passed between the handles 66, 86 of the child seat 10, and pulled tightly over the front edge 58 of the bottom panel 18 to pull the panels 18, 20 together with the rear sleeve 22 and loose portion of the support strap 24 positioned therebetween. The loop portion on the strap 90 is then pressed against the hook portion on the bottom surface 64 to hold the panels 18, 20 together.

In the collapsed position, the child seat 10 is streamlined and lightweight for easy travel and storage. The child seat 10 is also facilely converted from the collapsed travel position to the unfolded seat position by opening panels 18, 20 and rolling the rear sleeve 22 over the rear panel 20. The child seat 10 is also easily attached to a theater chair 12, as described above. When attached to the theater chair 12, the child seat sufficiently elevates the child so that the child may see over objects, such as a theater chair or person positioned or seated in front of the child.

The simple design of the child seat of the child seat 10 also reduces manufacturing costs, as well as weight. The design, however, is sufficiently sturdy to support a child weighing as much as fifty (50) pounds or so. The simple design of the child seat 10 also does not include any hardware which is likely to rip, tear or puncture the upholstery of the theater chair 12.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. A child seat for use with a chair of the type having a backrest and a seat, said child seat being collapsible from a seat position, in which, when attached to the chair, a child seated within the child seat is raised above the seat of the chair, to a travel position, in which the child seat is collapsed for easy carrying, said child seat comprising:

a generally rectangular bottom panel having a cushioned upper surface and a bottom surface, a first side edge and an opposing second side edge, and a front edge and an opposing rear edge, said front edge and said first side edge intersecting at a first front corner, and said front edge and said second side edge intersecting at a second front corner;

a generally rectangular, cushioned back panel having a bottom edge and a top edge, said bottom edge of said back panel and said rear edge of said bottom panel being hinged together such that said back panel and said bottom panel fold together when said child seat is collapsed into the travel position;

a rear sleeve attached to at least a portion of said top edge of said back panel, said sleeve forming a pocket configured to receive at least an upper portion of the chair backrest through an opening, said sleeve having a strap loop which surrounds at least a portion of said opening of said pocket, said rear sleeve further being invertible to fold from the seat position in which said rear sleeve is positioned on a rear side of said back panel to the travel position in which said rear sleeve is positioned on a front side of said back panel; and a support strap extending through said strap loop of said rear sleeve, from said rear sleeve to said first side edge of said bottom panel proximate to said first front corner, across said bottom surface of said bottom panel to said second side edge proximate to said second front corner, and from said second side edge to said rear sleeve, said support strap being slidably connected to said rear sleeve and fixedly attached to said first and second side edges of said bottom panel, said support strap further being adjustable in length so as to draw said rear sleeve around the chair backrest and to adjust the position of said bottom panel.

2. The child seat of claim 1, wherein said support strap extends from said first side edge proximate to a first side corner, diagonally across said front corner over said bottom surface towards the center of said front edge, extends from said front edge, loops back towards said front edge, attaches to said front edge proximate to said second front corner to form a handle, and extends from said front edge diagonally across said second front corner to said second side edge.

3. The child seat of claim 1 additionally comprising a handle attached to said back panel top edge inside said rear sleeve pocket with said rear sleeve in the seat position.

4. The child seat of claim 1 additionally comprising a retaining belt attached to said support strap on either side of the bottom panel and a central strap attached to said front edge of said bottom panel and to said retaining belt to retain a child within said child seat.

5. The child seat of claim 1, additionally comprising means for maintaining said bottom panel and said back panel folded in the travel position.

6. A child seat comprising:

a rigid bottom panel having a first side edge and a generally opposing second side edge spaced from said first edge by a distance sufficient to support the child's buttocks;

a rear panel being hinged to said bottom panel;

a rear sleeve attached to said rear panel, said sleeve comprising a pocket configured to receive at least an upper portion of the chair backrest and to define a top, a back and a pair of generally oppositely facing sides when positioned on the chair backrest; and a support strap extending between and coupled to said generally oppositely facing sides of said rear sleeve and each side edge of said bottom panel, said support strap extending around the chair backrest with said sleeve pocket receiving a portion of the chair backrest, said support strap being coupled to the bottom panel.

7. The child seat of claim 6, wherein said support strap fixedly attaches to a portion of a bottom surface of said bottom panel proximate to each side end.

8. The child seat of claim 7, wherein said support strap is attached to a first side end of said bottom surface, extends over said bottom surface towards to a front edge of said bottom panel, extends from said front edge and loops back towards said front edge proximate to form a handle, extends over said bottom surface to said second side end and is attached to said second side edge.

9. The child seat of claim 6 additionally comprising a handle extending from a front edge of said bottom panel, said handle being formed by said support strap.

10. The child seat of claim 6, wherein said rear sleeve is invertible to fold onto the front side of said back panel.

11. The child seat of claim 6, wherein said bottom panel includes a cushion.

12. The child seat of claim 6, additionally comprising a retaining belt attached to said support strap on either side of said bottom panel and a central strap attached to said retaining belt and to said bottom panel to retain a child within said child seat.

13. A child seat comprising:

a rigid bottom panel having a width defined between a first side edge and a generally opposing second side edge, the width of the bottom panel being wider than the seat of the child;

a rear panel being hinged to said bottom panel;

a rear sleeve attached to said rear panel, said sleeve comprising a pocket configured to receive at least an upper portion of the chair backrest and to define a top, a back and a pair of generally oppositely facing sides when positioned on the chair backrest, said rear sleeve additionally comprising a strap loop which extends around said rear sleeve behind said back panel along said back of said sleeve and along said generally oppositely facing sides of said sleeve; and a support strap extending through said strap loop and being attached to each side end of said bottom panel at a point distal of an interconnection between said bottom panel and said back panel, said support strap being fixedly attached to either the bottom panel or the rear sleeve, and slidably coupled to the other, said support strap being adjustable in length.

14. The child seat of claim 13, wherein said rear sleeve is invertible to fold onto the front side of said back panel.

15. The child seat of claim 13, wherein said support strap is fixedly attached to a portion of a bottom surface of said bottom panel proximate to said first side edge and to said second side edge.

16. The child seat of claim 13, wherein said bottom panel includes a cushion.

17. The child seat of claim 13 additionally comprising a retaining belt attached to said support strap on either side of said bottom panel and a central strap attached to said retaining belt and to said bottom panel to retain a child within said child seat.

18. The child seat of claim 13 additionally comprising a handle attached to said back panel.

19. The child seat of claim 13, wherein said rear panel and said bottom panel each comprise an outer shell which are formed of a rugged, aurable, washable material.

20. A method of supporting a child above a chair having a backrest and a seat, said method comprising the steps of:

providing a child seat comprising:

a bottom panel hinged to a back panel;

a rear sleeve attached to said back panel and having a pocket configured to receive at least an upper portion of said chair backrest; and a support strap slidably connected to said rear sleeve and attached to opposing side edges of said bottom panel;

folding said bottom panel away from said back panel to a position in which said bottom panel is generally normal to said back panel;

slipping said rear sleeve over at least an upper portion of the chair backrest to suspend the child seat from the chair backrest;

positioning said support strap around the back of said chair backrest; and adjusting the length of said support strap to draw the rear sleeve tightly around the chair backrest and to position said bottom panel in a position generally parallel to the chair seat.

21. A method as defined in claim 20 additionally comprising the steps of:

placing a child on top of said bottom panel suspended above the chair seat; and readjusting the length of the support strap to position said bottom panel in a position generally parallel to the chair seat when supporting the child.

22. A method as defined in claim 21 additionally comprising the steps of:

drawing a retaining belt, attached to the support strap on either side of said bottom panel, across the lap of the child to retain the child within the child seat; and positioning a central strap, attached to said retaining belt and to said bottom panel, between the legs of the child positioned on said bottom panel.

23. A method as defined in claim 22, additionally comprising the steps of:

removing said rear sleeve from the upper portion of the chair backrest;

inverting said rear sleeve so as to position said rear sleeve on the front side of said back panel;

folding said back panel and said bottom panel together with said rear sleeve and at least a portion of said support strap positioned therebetween; and maintaining said bottom panel and said back panel folded together.

24. A method as claimed in claim 23, additionally comprising the steps of:

providing at least one handle attached to an edge of said child seat; and carrying said child seat by said handle.

* * * * *

UNITED STATES PATENT AND TRADEMARK OFFICE

CERTIFICATE OF CORRECTION

PATENT NO. : 5,499,860

DATED : March 19, 1996

INVENTOR(S) : Raymond Smith

It is certified that error appears in the above-indentified patent and that said Letters Patent is hereby corrected as shown below:

Column 12, line 34 change "rugged, aurable" to --rugged, durable--.

Signed and Sealed this

Ninth Day of July, 1996

*Attest:*

*Attesting Officer*

BRUCE LEHMAN

*Commissioner of Patents and Trademarks*